US005779072A

United States Patent [19]

Krebs

[11] Patent Number: 5,779,072

[45] Date of Patent: Jul. 14, 1998

[54] SQUEEZE AND TURN FLIP TOP CHILD RESISTANT PACKAGE

[75] Inventor: John D. Krebs, Toledo, Ohio

[73] Assignee: Owens-Illinois Closure Inc., Toledo, Ohio

[21] Appl. No.: 802,703

[22] Filed: Feb. 19, 1997

[51] Int. Cl.[6] ..... B65D 50/04

[52] U.S. Cl. ..... 215/219; 215/225; 215/235; 215/303; 220/263; 222/153.14

[58] Field of Search ..... 215/201, 206, 215/208, 216, 217, 219, 223, 224, 225, 235, 237, 238, 243, 303, 320, 321, 353; 220/334, 335, 259, 256, 254, 263; 222/153.14

[56] References Cited

U.S. PATENT DOCUMENTS

| | | | |
|---|---|---|---|
| 2,120,510 | 6/1938 | Rhoades . | |
| 2,495,015 | 1/1950 | McGrath . | |
| 2,779,519 | 1/1957 | Rossetti . | |
| 3,690,521 | 9/1972 | Middleton . | |
| 3,703,250 | 11/1972 | Middleton . | |
| 3,871,662 | 3/1975 | Hepp et al. . | |
| 3,917,097 | 11/1975 | Uhlig . | |
| 4,117,945 | 10/1978 | Mumford . | |
| 4,375,859 | 3/1983 | Fillmore . | |
| 4,573,599 | 3/1986 | Fillmore . | |
| 4,941,580 | 7/1990 | Julian | 215/225 X |
| 5,065,876 | 11/1991 | Joyce | 215/225 X |
| 5,082,130 | 1/1992 | Weinstein | 215/225 |
| 5,551,582 | 9/1996 | Robinson | 215/225 X |
| 5,593,054 | 1/1997 | Glynn | 215/223 X |

*Primary Examiner*—Allan N. Shoap
*Assistant Examiner*—Nathan Newhouse

[57] ABSTRACT

A child resistant package includes a plastic container and a plastic closure. The container includes a body and a finish having an opening. The closure includes a base wall, an outer flexible peripheral skirt and an inner peripheral skirt. Interengaging retaining means on the finish of the container and the inner skirt of said closure restrict relative movement between said container and closure to rotary movement. The plastic closure also includes opposed flexible portions on said outer skirt and opposed lugs on the inner surface of the outer skirt. The container has opposed lugs on the finish engaging said lugs on said closure precluding rotation of said closure unless said flexible portions of said skirt are squeezed. A portion of the base wall of the closure is hinged to the base wall and normally lies in the same plane as the base wall. The container has a securing bead on the finish and the top portion has means engaging the securing bead. The container includes an inclined ramp. A cam follower is provided on said top portion of the closure such that when the outer skirt of the closure is squeezed and rotated, the cam follower engages the inclined ramp and the top portion is released from said securing bead.

9 Claims, 2 Drawing Sheets

SQUEEZE AND TURN FLIP TOP CHILD RESISTANT PACKAGE

This invention relates to child resistant packages and particularly to child resistant of the squeeze and turn type.

BACKGROUND AND SUMMARY OF THE INVENTION

One type of child resistant package that is well known in the prior art which is of the squeeze and turn type such as shown, for example, in U.S. Pat. Nos. 3,917,097 and 4,117,945. In such child resistant packages, the package is provided with locking lugs on the interior of the skirt of the closure and is unlocked by squeezing the closure at two locations, 180 degrees apart and 90 degrees with respect to the locking lugs on the container. The locking lugs on the closure abut cooperating lugs on the container finish when any attempt is made to remove the closure by rotation. It is also known to have child resistant package with a flip top closure which is actuated by pressing upwardly on a projection overcoming interference forces securing the flip top portion over an orifice or bead on the container finish. Such packages are shown in U.S. Pat. Nos. 3,871,662, 4,375,859 and 4,573,599.

Among the objectives of the present invention are to provide a child resistant package which is of the squeeze and turn type and includes a flip top closure; wherein when the closure is squeezed and turned, the flip top is released; and wherein the closure is adaptable to either cylindrical or other cross sections of containers.

In accordance with the invention, the child resistant package comprises a hollow container including a body and a finish having an opening. A plastic closure includes a base wall, an outer flexible peripheral skirt and an inner peripheral skirt. Interengaging retaining means on the finish of the container and the inner skirt of said closure restrict relative movement between said container and closure to rotary movement. The plastic closure also includes opposed flexible portions on said outer skirt and opposed lugs on the inner surface of the outer skirt. The container has opposed lugs on the finish engaging said lugs on said closure precluding rotation of said closure unless said flexible portions of said skirt are squeezed. A portion of the base wall of the closure is hinged to the base wall and normally lies in the same plane as the base wall. The container has a securing bead on the finish and the top portion has means engaging the securing bead. The container includes an inclined ramp. A cam follower is provided on said top portion of the closure such that when the outer skirt of the closure is squeezed and rotated, the cam follower engages the inclined ramp and the top portion is released from said securing bead.

DESCRIPTION OF THE PREFERRED EMBODIMENT

Figure 1:
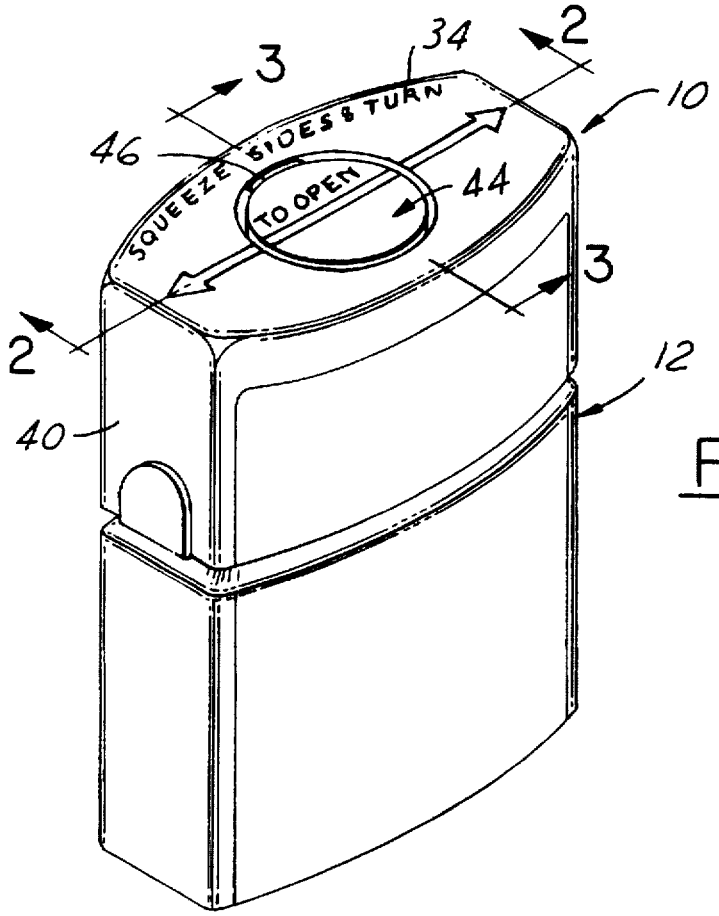
FIG. 1 is a perspective view of a child resistant package embodying the invention.
Figure 2:
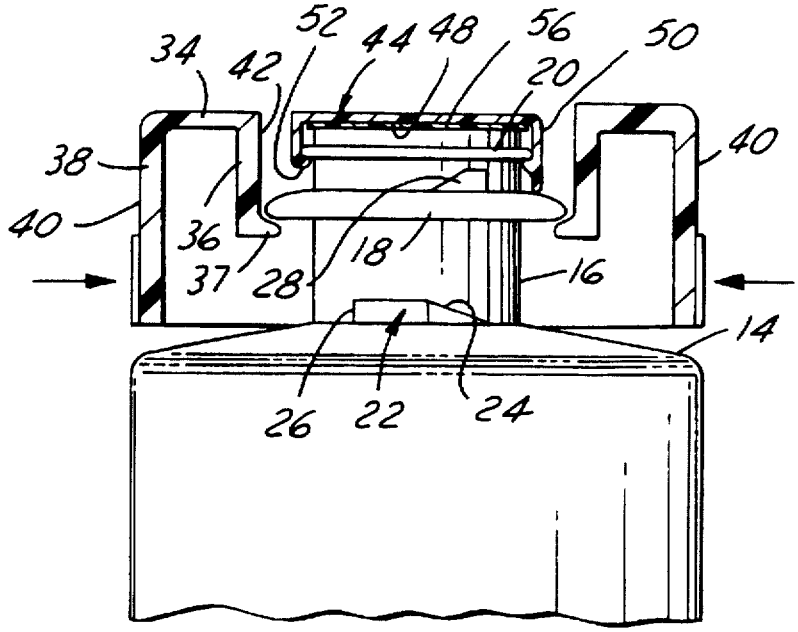
FIG. 2 is a fragmentary sectional view taken along the line 2—2 in FIG. 1.
Figure 3:
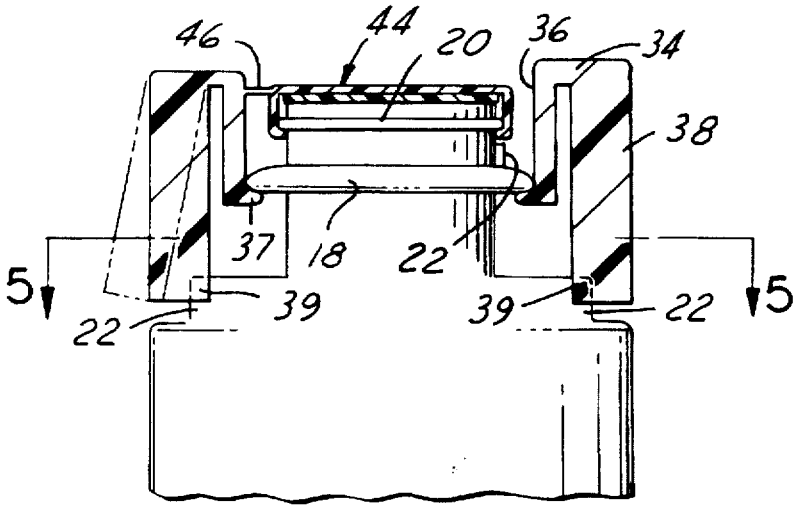
FIG. 3 is a fragmentary sectional view taken along the line 3—3 in FIG. 1.

Referring to FIGS. 1–7, the child resistant package embodying the invention comprises a closure 10 and a container 12, herein shown as having a modified oval cross section. The closure 10 is made of plastic such as polypropylene and the container 12 may be made of plastic or glass.

The container 12 includes a shoulder 14 and an integral finish 16 that includes a lower bead 18 and an upper bead 20, the lower bead 18 extending radially outwardly beyond the bead 20. The container 10 further includes integral cam lugs 22 at 180 degrees to one another on the central flat portion 15 of shoulder 14. Each lug 22 includes an inclined upper surface 24 at one end and a axial surface 26 at the other end. The integral finish 16 further includes an upwardly extending integral lug 28 on the upper surface of the lower bead 18 having an inclined surface 32.

The closure 10 includes an annular base wall 34, an inner annular skirt 36 and an outer annular skirt 38. The outer skirt 38 includes opposed finger engaging portions 40 that are 180 degrees apart and extend along the long axis of the container 10. The skirt 38 includes opposed axial lugs 39 on the inner surface of the outer skirt 38.

The inner skirt 36 of the closure 10 defines an opening 42 and has a bead 37 on the lower free end and a flip top portion or cover 44 is hinged by an integral hinge 46 to the base wall 34 for movement into and out of overlying relationship with the finish 16. The flip top cover 44 includes a base wall 48 and a peripheral skirt 50 having an internal annular bead 52 that is snapped below the upper bead 20 of the finish. A liner 56 is provided on the inner surface of the base wall 48 of the cover 46. The peripheral skirt 50 of the cover 44 includes a semi-circular cam projection 62 integral with the skirt 50 and projects downwardly into the path of the cam surface of the lug 28 on the finish.

The closure 12 is applied by axially moving the closure downwardly onto the finish 16 bringing the annular bead 37 on the inner surface of the inner skirt 36 into engagement with the lower bead 18 and the finish 16 and the cover 44 into engagement with the upper bead 20 on the finish 16.

Figure 4:
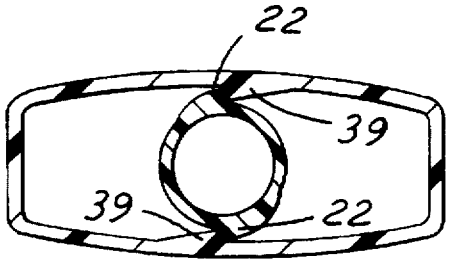
FIG. 4 is a sectional view taken along the line 4—4 in FIG. 3.
Figure 5:
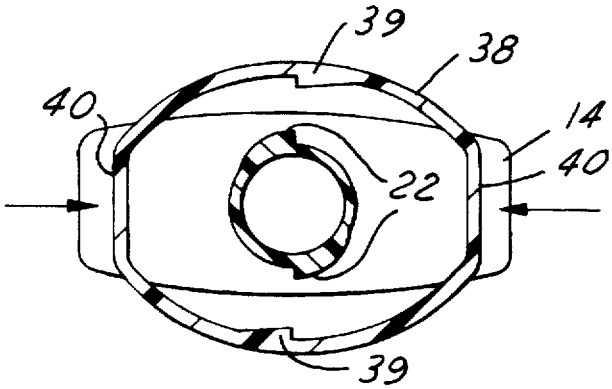
FIG. 5 is a view similar to FIG. 4 showing the relative position of the closure and container when the closure is squeezed.
Figure 6:
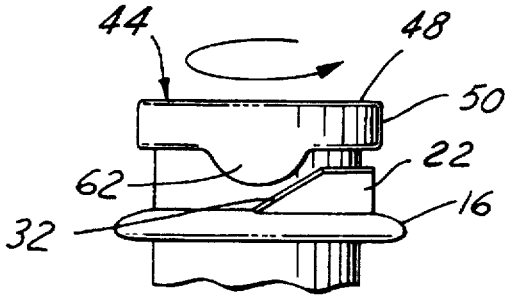
FIG. 6 is a fragmentary elevational view of the flip top portion of the closure and finish, parts being broken away.

When it is desired to open the closure 12, the opposed finger engaging portions 40 of the outer skirt 38 are manually engaged and the closure 10 is squeezed from the position shown in FIG. 4 to the position shown in FIG. 5 and rotated. As the closure 10 is rotated, the cam 62 on the skirt 50 of the flip top cover 44 engages the inclined surface 32 of cam 28 on the finish 16 causing the flip top cover 44 to be moved upwardly at this location thereby disengaging flip top cover bead 52 from upper bead 20 thereby opening the package. In order to close the package, the flip top cover 44 is pushed downwardly bringing the skirt 48 of the flip top cover 44 into engagement with the upper bead 20. During or before such action, the closure 12 is returned to its original aligned position with the container 10.

It can thus be seen that there has been provided a child resistant closure which is of the squeeze and turn type and includes a flip top closure; wherein when the closure is squeezed and turned, the flip top is released; and wherein the closure is adaptable to either cylindrical or cross sections of container.

I claim:

1. A child resistant package comprising a hollow container including a body and a finish having an opening, a plastic closure comprising a base wall, an outer flexible peripheral skirt and an inner peripheral skirt, interengaging retaining means on said finish of said container and said inner skirt of said closure restricting relative movement between said container and closure to rotary movement, said plastic closure comprising opposed flexible portions on said outer skirt, said plastic closure having opposed lugs on the inner surface of said outer skirt, said container having opposed lugs on said finish engaging said lugs on said closure precluding rotation of said closure unless said flexible portions of said skirt are squeezed, said plastic closure having a top portion of said base wall hinged to said base wall and normally lying in the same plane as said base wall, said container having a securing bead on said finish, said top portion having means engaging said securing bead, an inclined ramp on said container, and a cam follower on said top portion of said closure such that when said outer skirt of said closure is squeezed and rotated, said cam follower engages said inclined ramp and said top portion is released from said securing bead.

2. The child resistant package set forth in claim 1 wherein said top portion is recessed in said base wall of said closure.

3. The child resistant package set forth in claim 2 wherein said outer skirt of said closure and said body of said container have similar cross sections.

4. The child resistant package set forth in claim 3 wherein said interengaging retaining means is a shoulder, said inclined ramp being positioned as said shoulder.

5. The child resistant package set forth in any one of claims 1–4 wherein said container and closure are non-cylindrical in cross section.

6. The method of making a child resistant package comprising forming a hollow container including a body and a finish having an opening, forming a plastic closure comprising a base wall, an outer flexible peripheral skirt and an inner peripheral skirt, forming interengaging retaining means on said finish of said container and said inner skirt of said closure restricting relative movement between said container and closure to rotary movement, forming opposed flexible portions on said outer skirt of said closure, forming opposed lugs on the inner surface of said outer skirt, forming opposed lugs on said finish engaging said lugs on said closure precluding rotation of said closure unless said flexible portions of said skirt are squeezed, forming said plastic closure with a top portion of said base wall hinged to said base wall and normally lying in the same plane as said base wall, forming a securing bead on said finish, forming said top portion having engaging said securing bead, forming an inclined ramp on said finish, forming a cam follower on said top portion such that when said outer skirt of said closure is squeezed and rotated, said cam follower engages said inclined ramp and said top portion is released from said securing bead.

7. The method set forth in claim 6 wherein said step of forming said top portion is such that said top portion is recessed in said base wall of said closure.

8. The method set forth in claim 7 wherein said steps of forming said container and said closure are such that said outer skirt of said closure and said body of said container have similar cross sections.

9. The method set forth in claim 8 wherein said step of forming said interengaging retaining means includes forming a shoulder on said container and said step of forming said inclined ramp includes positioning said inclined ramp on said shoulder.

* * * * *